United States Patent [19]

Holland

[11] 3,952,784

[45] Apr. 27, 1976

[54] PENCIL POINTER

[75] Inventor: Donald L. Holland, Statesville, N.C.

[73] Assignee: Hunt Manufacturing Co., Philadelphia, Pa.

[22] Filed: Apr. 16, 1975

[21] Appl. No.: 568,479

[52] U.S. Cl. ..... 144/28.1; 145/3.31; 145/3.61

[51] Int. Cl.[2] ..... B43L 23/00

[58] Field of Search ..... 145/3.1, 3.2, 3.3, 3.31, 145/3.32, 3.5, 3.6, 3.61, 3.9; 144/28.9, 28.8, 28.11, 28.1

[56] References Cited

UNITED STATES PATENTS

| | | | |
|---|---|---|---|
| 1,202,325 | 10/1916 | Simmons | 144/28.1 |
| 1,248,733 | 12/1917 | Simmons | 144/28.1 |
| 1,256,383 | 2/1918 | Simmons | 144/28.1 |
| 2,785,657 | 3/1957 | Wolfson | 144/28.1 |
| 2,857,883 | 10/1958 | Pratt | 144/28.1 |
| 3,398,773 | 8/1968 | Dahle | 144/28.1 |

FOREIGN PATENTS OR APPLICATIONS

| | | | |
|---|---|---|---|
| 270,866 | 12/1950 | Switzerland | 144/28.1 |
| 1,114,725 | 10/1961 | Germany | 144/28.1 |

*Primary Examiner*—Al Lawrence Smith
*Assistant Examiner*—J. T. Zatarga
*Attorney, Agent, or Firm*—Smith, Harding, Earley & Follmer

[57] ABSTRACT

A pencil pointer which comprises a base, a cylindrical cutter mounted on the base, a rotatable pencil holder coaxial with the cutter and having a first guide means on said holder to guide the lead to a position adjacent the cutter, and a second guide means rotatably mounted above said first guide means and having a plurality of selectable openings of different diameters adapted to be rotated into registry with said first guide means. The pointer includes a lead cleaner.

2 Claims, 10 Drawing Figures

PENCIL POINTER

BACKGROUND OF THE INVENTION

Pencil pointers employing a fixed cutter and a rotatable pencil holder are well known to the art. Since mechanical lead holders have barrels of varying sizes, it has been known heretofore to provide a rotatable pencil holder with removable guides so that a guide of the desired diameter to match the diameter of the lead holder can be selected and placed in the guide. In accordance with this invention the guiding arrangement is such that the diameter to match the diameter of the pencil can be selected without the removal of any parts. An integral lead cleaner accompanies the pointer.

SUMMARY OF THE INVENTION

A pencil pointer which comprises a base, a cylindrical cutter mounted on the base, a rotatable pencil holder coaxial with the cutter and having a first guide means on said holder to guide the lead to a position adjacent the cutter, and a second guide means rotatably mounted above said first guide means and having a plurality of selectable openings of different diameters adapted to be rotated into registry with said first guide means. Advantageously a lead cleaner is integral with the pointer.

PREFERRED EMBODIMENT

Figure 1:
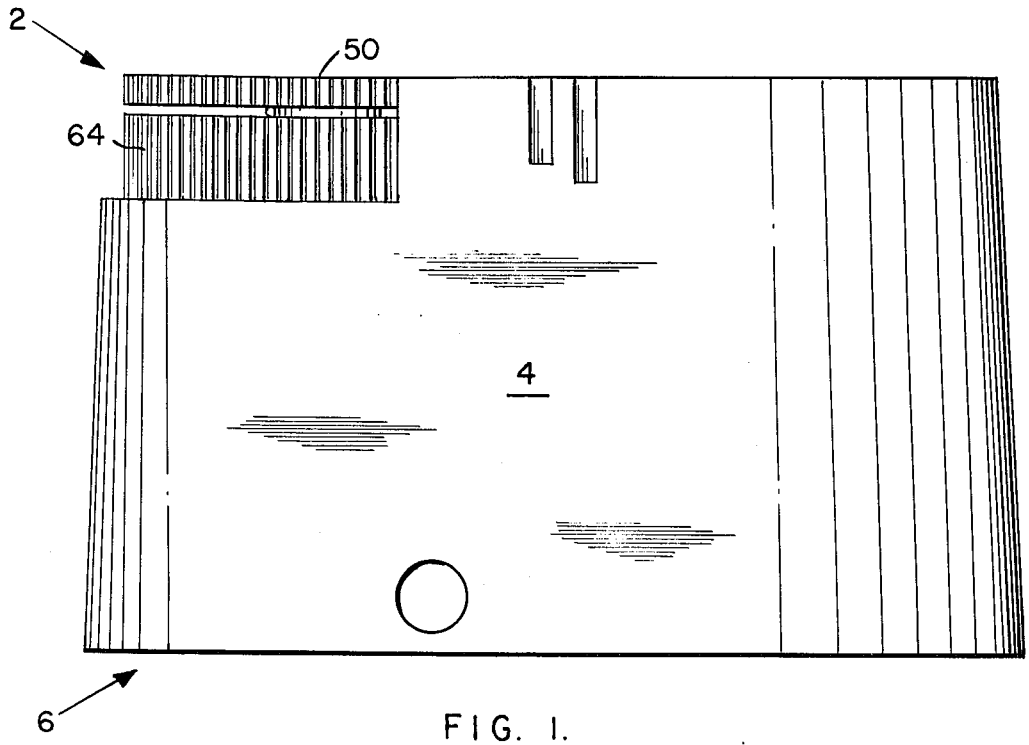
FIG. 1 is a front elevation of a pencil pointer in accordance with the invention.
Figure 2:
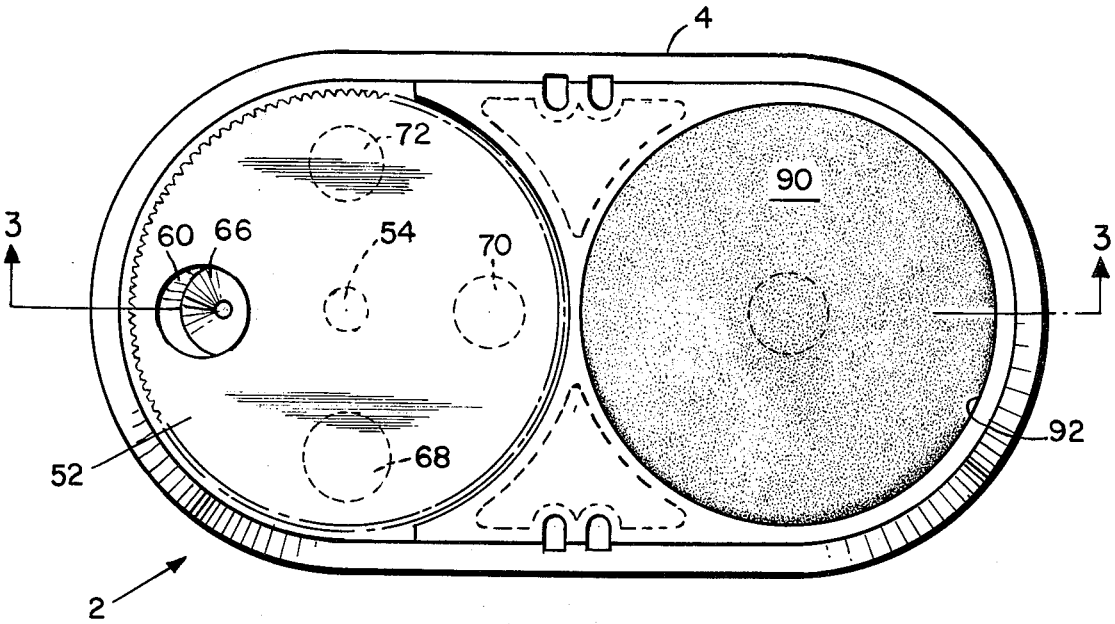
FIG. 2 is a top plan view of the pencil pointer of FIG. 1.
Figure 3:
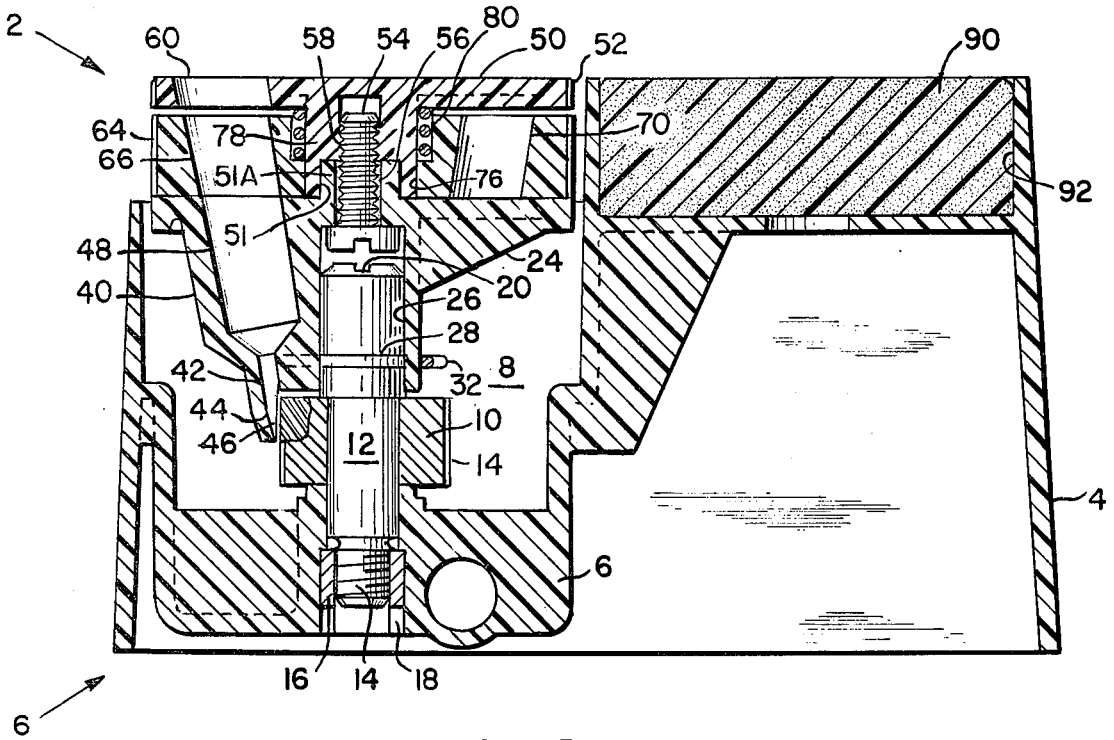
FIG. 3 is a vertical section taken on the plane indicated by the line 3—3 in FIG. 2.
Figure 4:
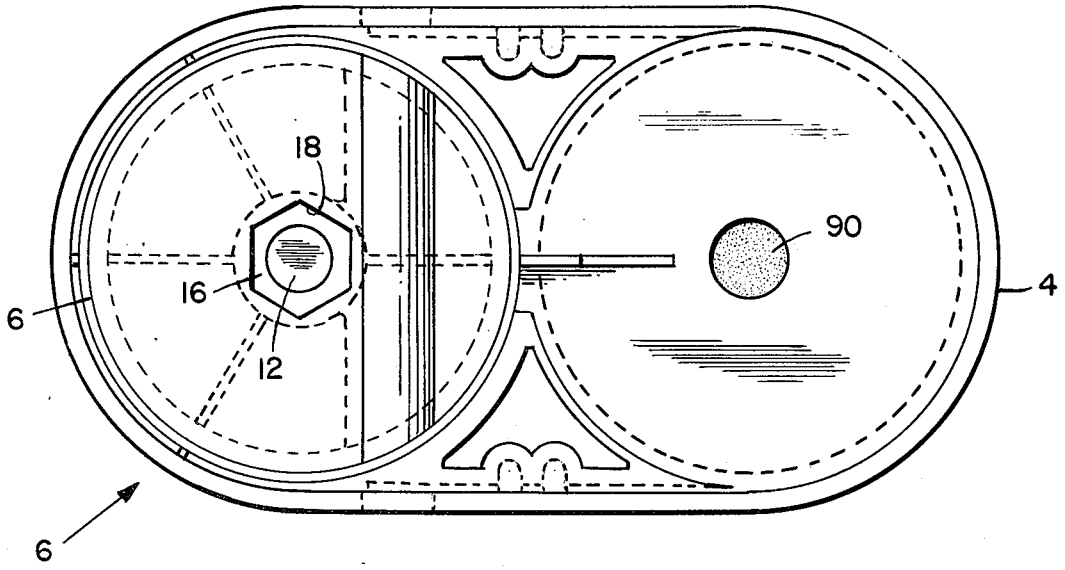
FIG. 4 is a bottom plan view of the pencil pointer of FIG. 1.
Figure 5:
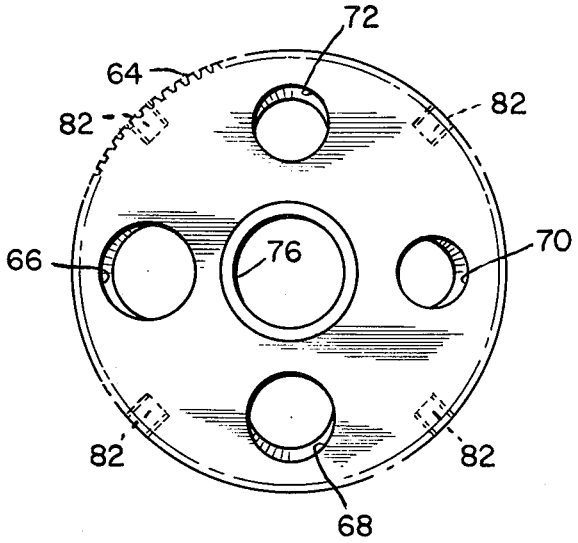
FIG. 5 is a top plan view of the adjustable guide means of the pencil pointer of FIG. 1.
Figure 6:
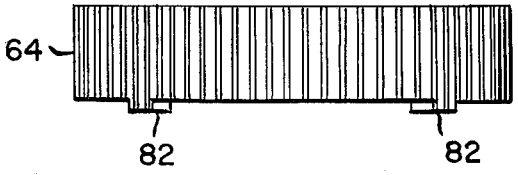
FIG. 6 is a side elevation of the guide means of FIG. 5.
Figure 7:
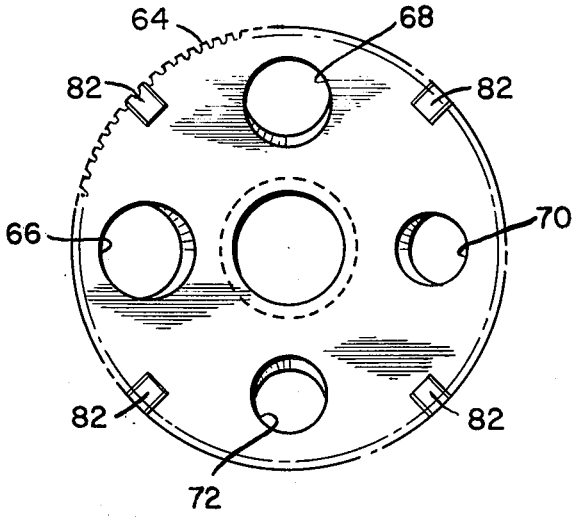
FIG. 7 is a bottom plan view of the guide means of FIG. 5.
Figure 8:
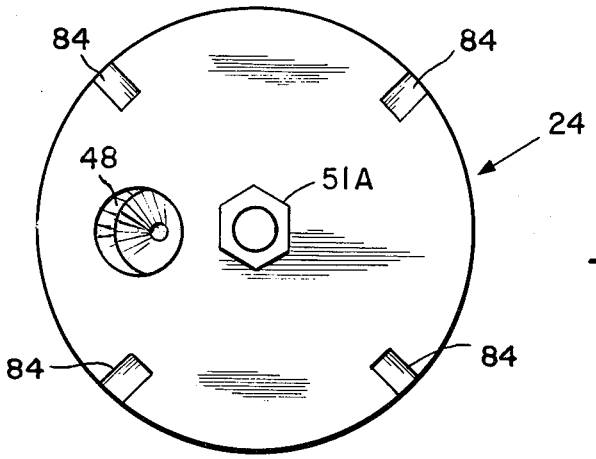
FIG. 8 is a top plan view of the rotatable pencil holder of the pencil pointer of FIG. 1.

A pencil pointer 2 has a housing 4 with a base member 6 at the bottom of a receptacle 8 within hoousing 4. A cutter 10 is mounted by a pressed fit on a vertical rod 12 which at its lower end has threads 14 engaged by a hexagonal nut 16 mounted in a hexagonal recess 18. Rod 12 is provided with a screwdriver slot 20.

Figure 9:
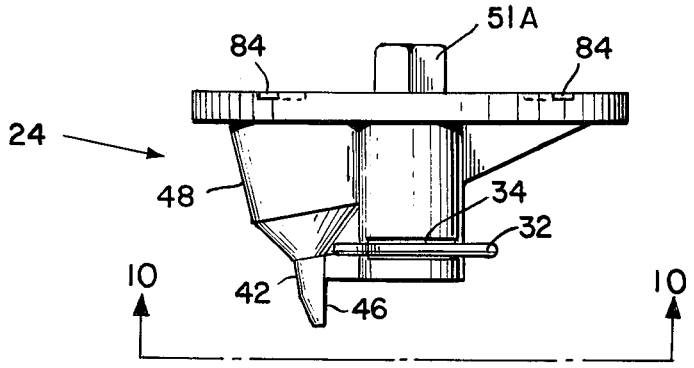
FIG. 9 is a side elevation of the rotatable pencil holder of FIG. 8.
Figure 10:
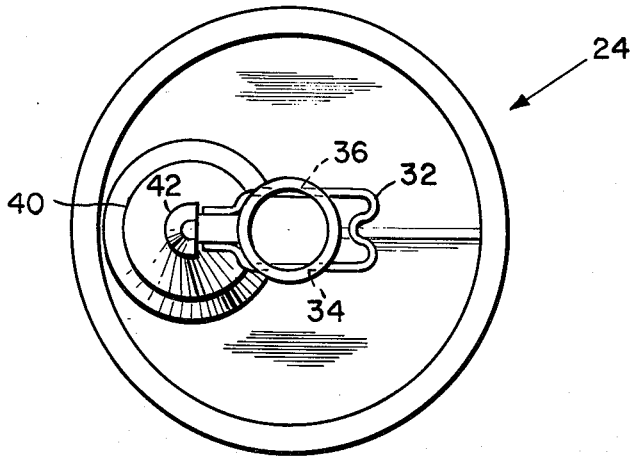
FIG. 10 is a bottom plan view of the rotatable pencil holder of FIG. 8.

A pencil holder 24 has a bore 26 which receives the upper end of rod 12 for the rotatable mounting of pencil holder 24. Rod 12 has a peripheral groove 28 which is engaged by a spring clip 32 which is received in slots 34 and 36 in the carrier 24 (FIGS. 9 and 10).

Holder 24 has a guide 40 which has a reduced diameter portion 42 for guiding a piece of lead. Reduced diameter portion 42 has a tapered lower end 44 with an opening 46 to expose a piece of lead to cutter 10.

Guide 40 has an enlarged diameter portion 48 for receiving the largest diameter lead holder contemplated.

A guide member 52 is fixedly secured to pencil holder 24 by a screw 54 which passes through an opening 56 in holder 24 and is threadedly secured to guide member 52 as indicated at 58. Guide member 52 has a hexagonal recess 51 which receives a hexagonal boss 51A on holder 24. Guide member 52 has an opening 60 which is coaxial with guide 40.

A guide member 64 between holder 24 and guide member 52 has a plurality of openings 66, 68, 70 and 72 which are adapted to register with opening 60 and guide 40. Opening 66 has a diameter equal to the diameter of enlarged portion 48 of guide 40 and each opening 68, 70 and 72 has a successively smaller diameter. Guide member 64 has a hub 76 which rotatably engages the exterior of boss 78 on guide member 52.

A compression coil spring 80 surrounds boss 78 and abuts against the lower face of member 52 and against hub 76 to urge guide member 64 downwardly against holder 24. Guide member 64 has downwardly extending projections 82 spaced 90° apart and adapted to engage recesses 84 spaced 90° apart on the upper face of carrier 24.

A piece of foamed resin 90, for example foamed polyethylene or foamed polypropylene, is positioned in a cavity 92 in housing 4 to provide for the cleaning of the lead after it has been pointed.

OPERATION

The opening amongst openings 66, 68, 70 and 72 best accommodating the pencil holder is selected by raising the member 64 against the force of spring 80 to release the projections 82 from recesses 84 and then rotating until the selected opening registers with opening 60 at which point member 64 is released and spring 80 causes projections 82 to enter openings 84. The lead holder is then inserted and used to rotate guide member 52 and guide member 64 to cause the end of the lead in the holder to be abraded into a sharp point by cutter 10. After the pointing the lead is cleaned by pushing it into the foamed resin 90.

It will be understood that the above described embodiment is illustrative and is not intended to be limiting.

What I claim is:

1. A pencil pointer comprising:

a base, a cylindrical cutter mounted on the base, a rotatable pencil holder coaxial with the cutter, first guide means on said holder having an opening to guide the lead to a position adjacent the cutter, second guide means rotatably mounted above said first guide means and having a plurality of selectable openings of different diameters adapted to be rotated into registry with said first guide means, detent means to hold the second guide means in a selected position, and third guide means overlying the second guide means, fixedly secured to the pencil holder and having an opening coaxial with the first guide means opening and having a diameter at least as large as the diameter of the largest opening in the second guide means.

2. A pencil pointer comprising:

a base, a cylindrical cutter mounted on the base, a rotatable pencil holder coaxial with the cutter and having a recess in its upper face for the reception of a projection, first guide means on said holder having an opening to guide the lead to a position adjacent the cutter, second guide means rotatably mounted above said first guide means having a plurality of selectable openings of different diameters adapted to be rotated into registry with said first guide means and having a downwardly extending projection adapted to be received in said recess to hold the second guide means in a predetermined position, third guide means overlying the second guide means fixedly secured to the pencil holder and having an opening coaxial with the first guide means opening with a diameter at least as large as the diameter of the largest opening in the second guide means, a spring mounted between the second and third guide means to bias the second guide means toward the pencil holder, and a receptacle below the cutter.

* * * * *